US010791882B1

(12) United States Patent
Meehan

(10) Patent No.: US 10,791,882 B1
(45) Date of Patent: Oct. 6, 2020

(54) TOILET PAPER GUIDE SYSTEMS

(71) Applicant: Steven Meehan, Bethlehem, CT (US)

(72) Inventor: Steven Meehan, Bethlehem, CT (US)

( * ) Notice: Subject to any disclaimer, the term of this patent is extended or adjusted under 35 U.S.C. 154(b) by 702 days.

(21) Appl. No.: 15/069,803

(22) Filed: Mar. 14, 2016

Related U.S. Application Data

(60) Provisional application No. 62/234,186, filed on Sep. 29, 2015.

(51) Int. Cl.

| | |
|---|---|
| ***A47K 10/16*** | (2006.01) |
| ***A47K 10/38*** | (2006.01) |
| ***A47K 10/32*** | (2006.01) |
| ***A47K 10/18*** | (2006.01) |

(52) U.S. Cl.
CPC ..... *A47K 10/16* (2013.01); *A47K 10/18* (2013.01); *A47K 10/32* (2013.01); *A47K 10/38* (2013.01); *A47K 2010/389* (2013.01)

(58) Field of Classification Search
CPC ... Y10T 83/889; Y10T 83/896; Y10T 83/902; Y10T 225/10; Y10T 225/20; Y10T 225/21; Y10T 225/211; A47K 10/38; A47K 10/00; A47K 10/16; A47K 10/18; A47K 10/22; A47K 10/24; A47K 10/32; A47K 2010/389; B65H 16/00; B65H 16/02; B65H 16/06
USPC ..... 242/550, 570, 551, 553, 562, 566, 579, 242/580, 580.1, 598
See application file for complete search history.

(56) References Cited

U.S. PATENT DOCUMENTS

| | | | | |
|---|---|---|---|---|
| 814,598 | A * | 3/1906 | Finan | A47K 10/38 225/71 |
| 1,059,572 | A * | 4/1913 | Schoettler | A47K 10/22 225/69 |
| 2,331,791 | A | 3/1942 | Noel | |
| 2,576,526 | A | 9/1949 | Marchand | |
| 2,647,028 | A * | 7/1953 | Larson | A47K 10/3827 225/6 |
| 6,241,180 | B1 | 6/2001 | Potter | |
| 7,784,659 | B2 * | 8/2010 | Bilotti | A47K 10/38 206/409 |
| 2008/0169411 | A1 * | 7/2008 | Quinn | A47K 10/32 248/691 |
| 2008/0185353 | A1 | 8/2008 | Immerman | |
| 2015/0083743 | A1 * | 3/2015 | D'Angelo | A47K 10/38 221/45 |

* cited by examiner

*Primary Examiner* — Phong H Nguyen
(74) *Attorney, Agent, or Firm* — Integrity Patent Group, PLC; Charles E. Runyan

(57) ABSTRACT

A toilet paper guide system having two hooks that hang on a toilet paper dispenser and a slot opening located at the bottom where the toilet paper enters the device. The device may provide for easy access to the toilet paper end and save the user from spending time trying to find the end of the toilet paper roll.

17 Claims, 5 Drawing Sheets

TOILET PAPER GUIDE SYSTEMS

CROSS-REFERENCE TO RELATED APPLICATION

The present application is related to and claims priority from prior provisional application Ser. No. 62/234,186, filed Sep. 29, 2015 which application is incorporated herein by reference.

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of bathroom accessory and more specifically relates to a toilet paper guide system.

2. Description of Related Art

Toilet paper is a tissue paper product primarily used by both human males and females for wiping and cleaning the anus and surrounding area of fecal material after defecation. It also acts as a layer of protection for the hands during these processes. It is sold as a long strip of perforated paper wrapped around a paperboard core for storage in a dispenser by a toilet. Most modern toilet paper in the developed world is designed to decompose in septic tanks, whereas some other bathroom and facial tissues are not. Toilet paper comes in one-ply all the way up to six-ply, meaning that it is either a single sheet or multiple sheets placed back-to-back to make it thicker, softer, stronger and more absorbent. Many times toilet paper is dispensed from a rolling means.

It can be difficult to locate the end of a toilet paper roll, forcing people to spin the roll around several times until they find the loose piece. Unfortunately, this can be time consuming, frustrating, and inconvenient, especially when in a hurry or time crunch. A suitable solution is desirable.

Several attempts have been made to solve the above-mentioned problems such as those found in U.S. Pub. No. 20080185353 to Robert A. Immerman, U.S. Pat. No. 7,784,659 to John D. Bilotti; U.S. Pat. No. 2,331,791 to Henry D Noel; U.S. Pat. No. 2,576,526 to Marchand Adolph; and U.S. Pat. No. 6,241,180 to David S. Potter. This art is representative of bathroom accessories. However, none of the above inventions and patents, taken either singly or in combination, is seen to describe the invention as claimed.

Preferably, a toilet paper guide system should provide convenient access to the end of a toilet paper roll and, yet would operate reliably and be manufactured at a modest expense. Thus, a need exists for a reliable toilet paper guide system to avoid the above-mentioned problems.

BRIEF SUMMARY OF THE INVENTION

In view of the foregoing disadvantages inherent in the known bathroom accessory art, the present invention provides a novel toilet paper guide system. The general purpose of the present invention, which will be described subsequently in greater detail is to provide a convenient access to the end of a toilet paper roll.

The present invention provides easy and convenient access to the end of a toilet paper roll and effectively alleviates the hassle associated with spinning the roll around and searching for the end. As designed, the present device saves a considerable amount of time and reduces frustration and annoyance. As such it makes a trip to the bathroom a better experience.

A toilet paper guide system is disclosed herein, in a preferred embodiment, comprising: a toilet paper guide assembly having a right-hook-member comprising a right-terminal-end, and a right-hook-end, a left-hook-hook-member, a left-terminal-end, and a left-hook-end, and a sleeve assembly comprising a front-plate with a thumb-opening and a tear-edge, and a back-plate. The toilet paper guide system, as such, comprises the toilet paper guide assembly. The toilet paper guide assembly comprises in functional combination the right-hook-member, the left-hook-hook-member, and the sleeve assembly.

The sleeve assembly comprises the front-plate and the back-plate. The sleeve assembly comprises an opening for toilet paper to be inserted through and an exit by which toilet paper is able to egress. The sleeve assembly is mounted to the right-terminal-end and the left-hook-member with the front-plate and the back-plate running parallel to each other and the right-terminal-end and the left-hook-member running parallel to each other, the right-terminal-end and the left-hook-member mounted perpendicular to the sleeve assembly. The left-hook-hook-member and the left-hook-hook-member are parallel to each other when hung from a toilet-paper-roll-holder. The thumb-opening is structured and arranged for gripping the toilet paper in the sleeve assembly. The thumb-opening is located in the front-plate. The thumb-opening comprises a negative space. The front-plate further comprises the tear-edge to pull the toilet paper against when dislodging an appropriate amount of sheets of the toilet paper has occurred. The toilet paper is dispensed vertically as the roll is sequentially pulled from the roll; the toilet paper is torn horizontally.

The right-hook-member is defined by the right-terminal-end and the right-hook-end. The left-hook-hook-member is defined by the left-terminal-end, and the left-hook-end. The right-terminal-end of the right-hook-member and the left-terminal-end of the left-hook-member are rearward facing with an orientation nearest a wall when hung. The toilet paper guide assembly is removably mounted to the toilet-paper-roll-holder and allows for easy and convenient access to an end sheet of a roll of the toilet paper such that a user can grasp the toilet paper and pull for dispensing for use. Certain embodiments may be adjustable at the right-hook-member or left-hook-member to allow freedom of vertical adjustment as desired via threading means or other such suitable equivalent.

A kit is described herein including: at least one the toilet paper guide assembly, and a set of user instructions.

A method of using a toilet paper guide system is also disclosed herein comprising the steps of: removably mounting a toilet paper guide assembly from a toilet-paper-roll-holder such that the toilet paper guide assembly occupies a hung-position below a roll of toilet paper, and feeding an end of a roll of toilet paper through a sleeve assembly such that a user can grasp the toilet paper and pull for dispensing for use. The method may further comprise the step of: tearing the toilet paper by sustained contact against a tear-edge when dislodging an appropriate amount of sheets of the toilet paper has occurred.

The present invention holds significant improvements and serves as a toilet paper guide system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, toilet paper guide system, constructed and operative according to the teachings of the present invention.

The various embodiments of the present invention will hereinafter be described in conjunction with the appended drawings, wherein like designations denote like elements.

DETAILED DESCRIPTION

Figure 1:
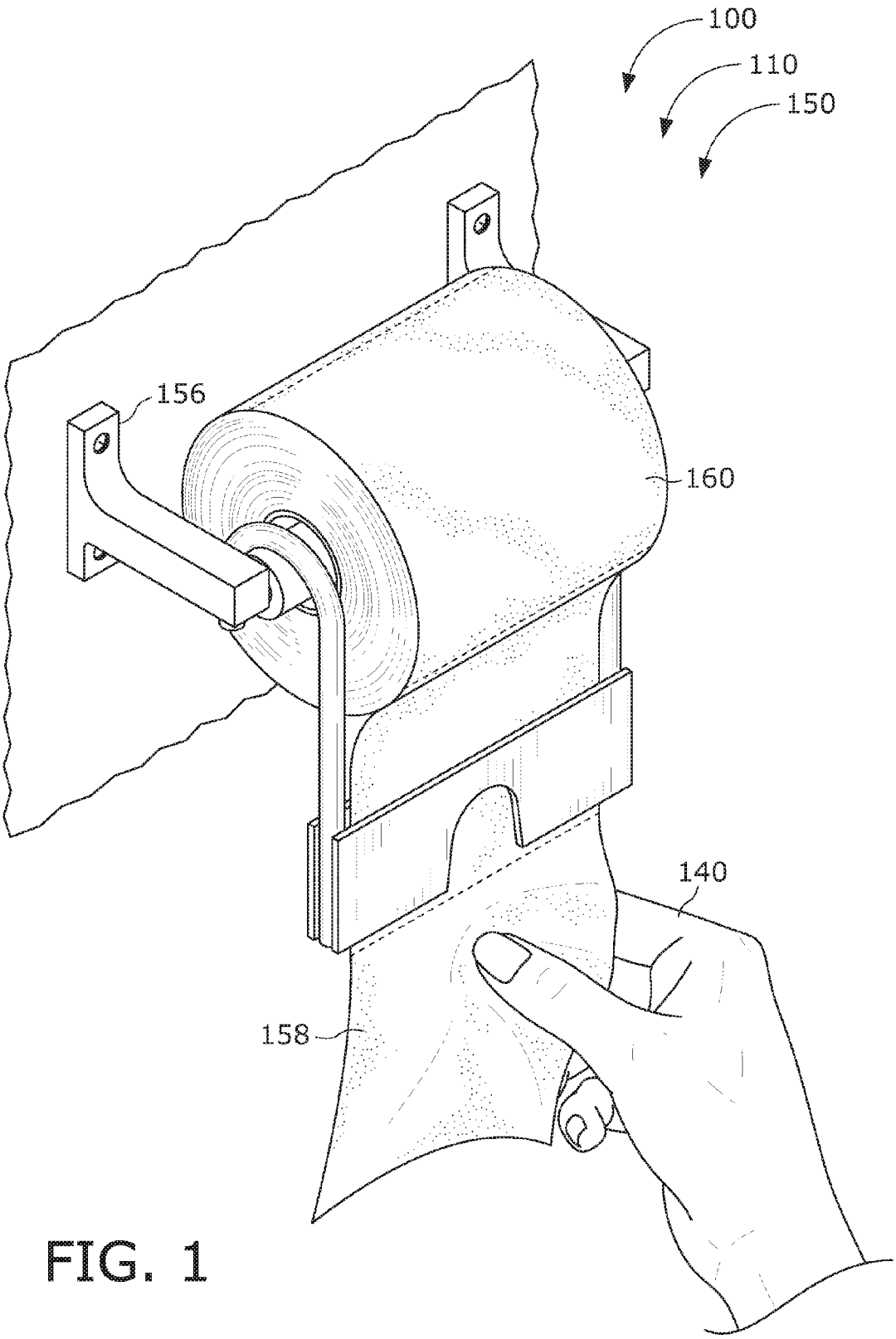
FIG. 1 shows a perspective view illustrating a toilet paper guide system during an 'in-use' condition showing right-hook-member and a left-hook-member according to an embodiment of the present invention.
Figure 2:
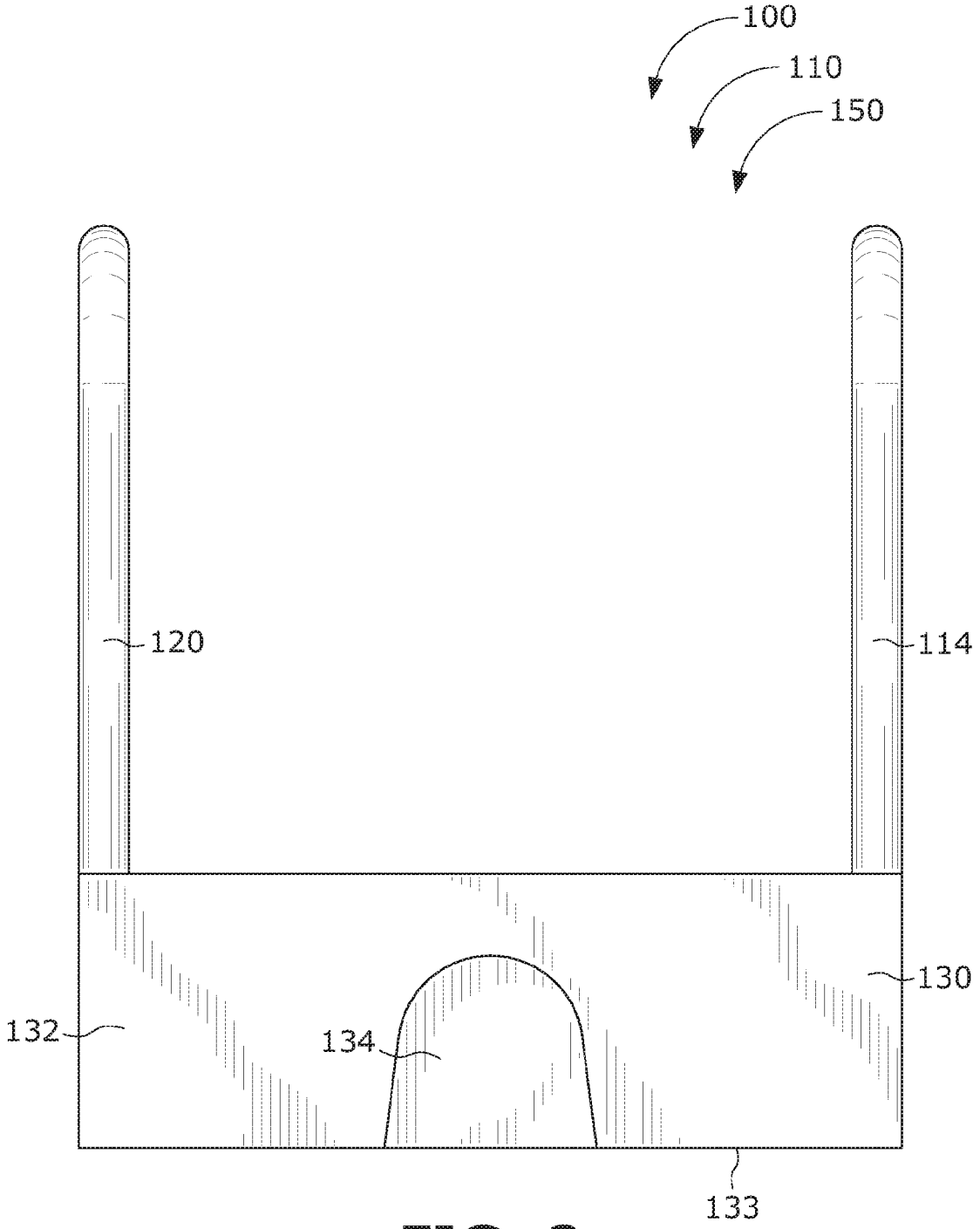
FIG. 2 is a front view illustrating the toilet paper guide system comprising a toilet paper guide assembly according to an embodiment of the present invention of FIG. 1.
Figure 3:
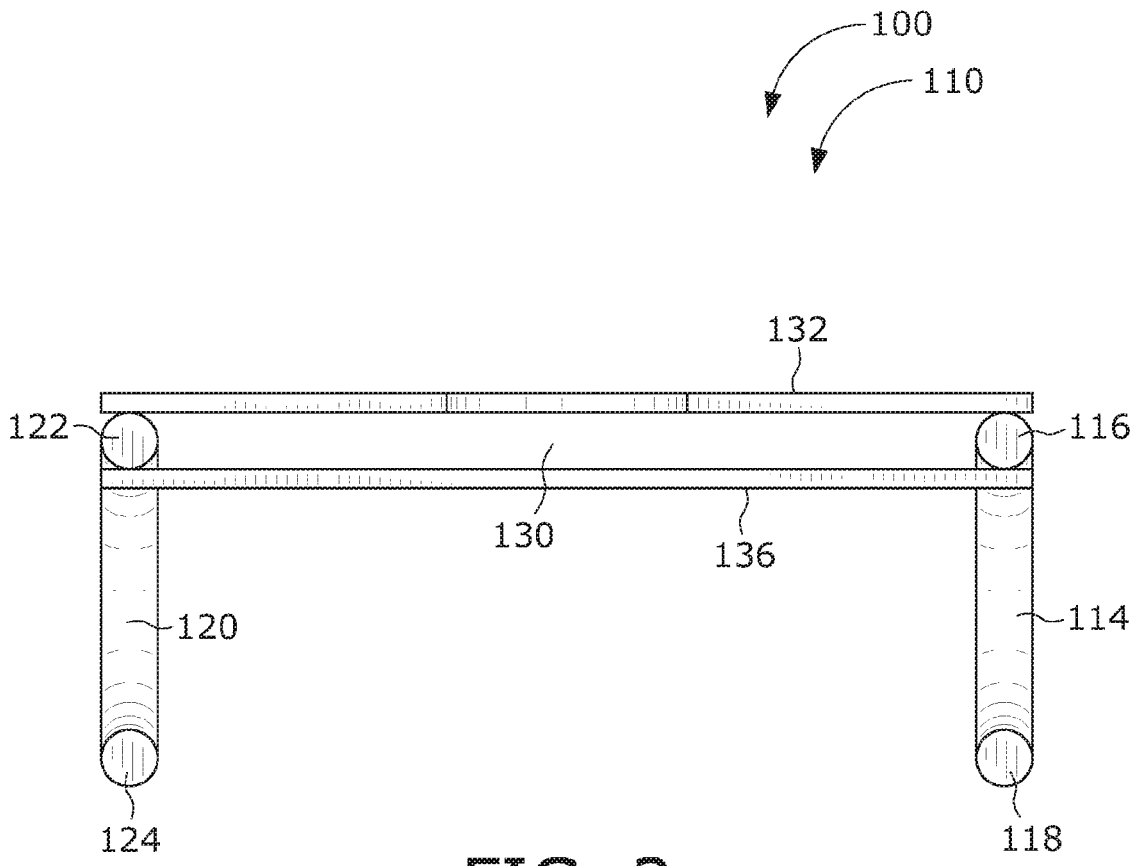
FIG. 3 is a bottom view illustrating the toilet paper guide assembly according to an embodiment of the present invention of FIGS. 1-2.

As discussed above, embodiments of the present invention relate to a bathroom accessory and more particularly to a toilet paper guide system as used to improve the accessibility of the end of a toilet paper roll.

Generally speaking, EASY ENDER™ provides an easy way to locate the end of a toilet paper roll every time. This innovative product may comprise an adjustable toilet paper guide with two hooks that can hang on a toilet paper dispenser. Further, the guide can have a slot opening at the bottom where toilet paper can enter the guide. In use, a user tears off a desired section of toilet paper from the roll below the slot, ensuring the next person can simply grab the paper below the slot without any hassle. The guide can be made from plastic or other suitable material, and can measure approximately 5.5" in height and 4.5" in width.

Referring to the drawings by numerals of reference there is shown in FIGS. 1-4, various views of toilet paper guide system 100 comprising: toilet paper guide assembly 110 in an "in-use" condition 150 (FIG. 1) having right-hook-member 114 comprising right-terminal-end 116, and right-hook-end 118, left-hook-member 120, left-terminal-end 122, and left-hook-end 124, sleeve assembly 130 comprising front-plate 132, and back-plate 136. Toilet paper guide system 100 comprises toilet paper guide assembly 110. Toilet paper guide assembly 110 comprises in functional combination right-hook-member 114, left-hook-member 120, and sleeve assembly 130. Sleeve assembly 130 comprises front-plate 132 and back-plate 136. Sleeve assembly 130 is mounted to right-terminal-end 116 and left-terminal-end 122 with front-plate 132 and back-plate 136 running parallel to each other and right-terminal-end 116 and left-terminal-end 122 running parallel to each other, right-terminal-end 116 and left-terminal-end 122 mounted perpendicular to sleeve assembly 130.

Right-hook-member 114 is defined by right-terminal-end 116 and right-hook-end 118. Left-hook-member 120 is defined by left-terminal-end 122, and left-hook-end 124. Toilet paper guide assembly 110 is removably mounted to toilet-paper-roll-holder 156 and allows for easy and convenient access to end of roll of toilet paper 158 such that user 140 can grasp roll of toilet paper 160 and pull for dispensing for use. Toilet paper guide assembly 110 of toilet paper guide system 100 comprises plastic, composite or metal for extended durability in use. Sleeve assembly 130 comprises an opening for toilet paper 160 to be inserted through and an exit by which toilet paper 160 egresses.

Left-hook-member 120 and right-hook-member 114 are parallel to each other when hung from a toilet-paper-roll-holder 156 as shown in FIG. 1. Toilet paper 160 is dispensed vertically as toilet paper 160 is sequentially pulled from roll. Toilet paper guide assembly 110 is preferably greater than 5 inches tall. Toilet paper guide assembly 110 is less than 5 inches tall in alternate embodiments.

Figure 4:
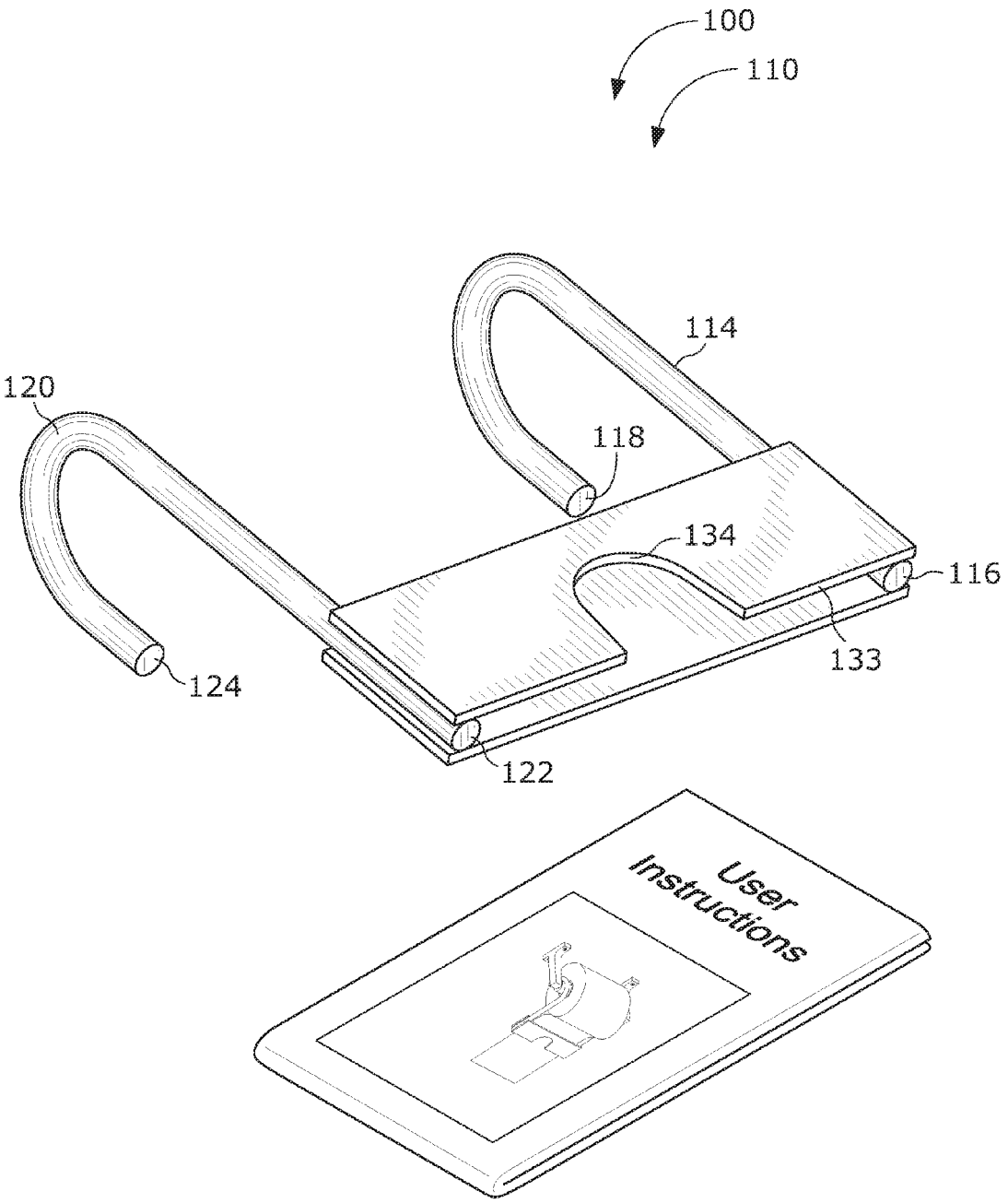
FIG. 4 is a perspective view illustrating a kit for the toilet paper guide system according to an embodiment of the present invention of FIGS. 1-3.

Toilet paper guide assembly 110 may be greater than 4.5 inches wide. Toilet paper guide assembly 110 may be equal to or less than 4.5 inches wide. Sleeve assembly 130 comprises thumb-opening 134 for gripping toilet paper 160 in sleeve assembly 130. Thumb-opening 134 is located in front-plate 132, as shown in FIG. 4. Thumb-opening 134 comprises a negative space. Right-terminal-end 116 of the right-hook-member 114 is rearward facing with an orientation nearest a wall when hung as shown in FIG. 1. Left-terminal-end 122 of left-hook-member 120 is rearward facing with an orientation nearest a wall when hung. Front-plate 132 comprises tear-edge 133 to pull toilet paper 160 against when dislodging an appropriate amount of sheets of toilet paper 160 has passed through sleeve assembly 130.

It should be noted that toilet paper guide system 100 may be sold as kit (shown in FIG. 4) comprising the following parts: at least one the toilet paper guide assembly 110, and a set of user instructions. The kit has instructions such that functional relationships are detailed in relation to the structure of the invention (such that the invention can be used, maintained, or the like in a preferred manner). Toilet paper guide system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different hanging combinations, parts may be sold separately, etc., may be sufficient.

Figure 5:
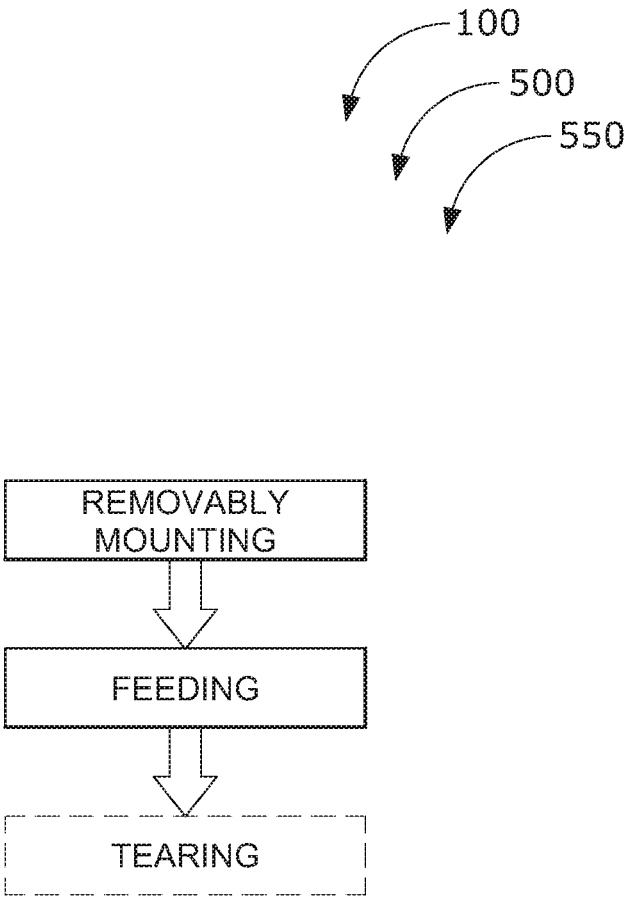
FIG. 5 is a flowchart illustrating a method of use for the toilet paper guide system according to an embodiment of the present invention of FIGS. 1-4.

Referring now to FIG. 5 showing flowchart 550 illustrating method of use 500 for toilet paper guide system 100 according to an embodiment of the present invention of FIGS. 1-4. As shown, method of use 500 may comprise the steps of: step one 501, removably mounting toilet paper guide assembly 110 from toilet-paper-roll-holder 156 such that toilet paper guide assembly 110 occupies a hung-position below roll of toilet paper 160; step two 502, feeding an end of a roll of toilet paper 158 through a sleeve assembly 130 such that user 140 can grasp toilet paper 160 and pull for dispensing for use; step three 503, tearing toilet paper 160 by sustained contact against a tear-edge 133 when dislodging an appropriate amount of sheets of toilet paper 160 has occurred.

It should be noted that step three 503 is an optional step and may not be implemented in all cases. Optional steps of method of use 500 are illustrated using dotted lines in FIG. 5 so as to distinguish them from the other steps of method of use 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A toilet paper guide system comprising:

a toilet paper guide assembly comprising a right-hook-member having a right-terminal-end and a right-hook-end;

a left-hook-member having a left-terminal-end and a left-hook-end; and a sleeve assembly having a front-plate and a back-plate, wherein said toilet paper guide assembly comprises in functional combination said right-hook-member, said left-hook-member, and said sleeve assembly;

wherein said sleeve assembly is mounted to said right-terminal-end and said left-terminal-end with said front-plate and said back-plate running parallel to each other and said right-terminal-end and said left-terminal-end running parallel to each other, said right-terminal-end and said left-terminal-end mounted perpendicular to said sleeve assembly; and wherein said toilet paper guide assembly is removably mounted to a toilet-paper-roll-holder and allows for easy and convenient access to an end of a roll of toilet paper such that a user can grasp said toilet paper and pull for dispensing for use; and wherein the toilet-paper-roll-holder comprises a frame and a bar mounted to the frame, wherein the bar is configured to extend through a core tube of a toilet paper roll, and wherein the right-hook-member and the left-hook-member are mounted on the bar.

2. The toilet paper guide system of claim 1 wherein said toilet paper guide system comprises plastic.

3. The toilet paper guide system of claim 2 wherein said toilet paper guide system comprises metal for extended durability in use.

4. The toilet paper guide system of claim 1 wherein said sleeve assembly comprises an opening for toilet paper to be inserted through and an exit by which said toilet paper egresses.

5. The toilet paper guide system of claim 1 wherein said left-hook-hook-member and said left-hook-hook-member are parallel to each other when hung from a toilet-paper-roll-holder.

6. The toilet paper guide system of claim 5 wherein said right-hook-end of said right-hook-member is rearward facing with an orientation nearest a wall when hung.

7. The toilet paper guide system of claim 5 wherein said left-hook-end of said left-hook-member is rearward facing with an orientation nearest a wall when hung.

8. The toilet paper guide system of claim 1 wherein said toilet paper is dispensed vertically as said roll is sequentially pulled from said roll.

9. The toilet paper guide system of claim 1 wherein said toilet paper guide assembly is about 5 inches tall.

10. The toilet paper guide system of claim 1 wherein said toilet paper guide assembly is about 4.5 inches wide.

11. The toilet paper guide system of claim 1 wherein said sleeve assembly comprises a thumb-opening for gripping said toilet paper in said sleeve assembly.

12. The toilet paper guide system of claim 11 wherein said thumb-opening is located in said front-plate.

13. The toilet paper guide system of claim 1 wherein said front-plate comprises a tear-edge to pull said toilet paper against when dislodging an appropriate amount of sheets of said toilet paper has occurred.

14. A toilet paper guide system comprising:

a toilet paper guide assembly comprising:

a right-hook-member having a right-terminal-end and a right-hook-end;

a left-hook-member having a left-terminal-end and a left-hook-end; and a sleeve assembly having a front-plate with a thumb-opening and a tear-edge, and a back-plate;

wherein said toilet paper guide assembly comprises in functional combination said right-hook-member, said left-hook-member, and said sleeve assembly;

wherein said thumb-opening of said sleeve assembly is configured for toilet paper to be inserted through and an exit by which toilet paper can egress;

wherein said sleeve assembly is mounted to said right-terminal-end and said left-terminal-end with said front-plate and said back-plate running parallel to each other and said right-terminal-end and left-terminal-end running parallel to each other, said right-terminal-end and said left-terminal-end mounted perpendicular to said sleeve assembly;

wherein said right-hook-member and said left-hook-member are parallel to each other when hung from a toilet-paper-roll-holder;

wherein said thumb-opening is structured and arranged for gripping said toilet paper in said sleeve assembly;

wherein said front-plate comprises said tear-edge to pull said toilet paper against when dislodging an appropriate amount of sheets of said toilet paper has occurred;

wherein said toilet paper is dispensed vertically as said roll is sequentially pulled from said roll;

wherein said right-hook-end of said right-hook-member and said left-hook-end of said left-hook-member are rearward facing with an orientation nearest a wall when hung; and wherein said toilet paper guide assembly is removably mounted to said toilet-paper-roll-holder and allows for easy and convenient access to an end sheet of a roll of said toilet paper such that a user can grasp said toilet paper and pull for dispensing for use; and wherein said toilet paper guide assembly is removably mounted to said toilet-paper-roll- holder and allows for easy and convenient access to an end sheet of a roll of said toilet paper such that a user can grasp said toilet paper and pull for dispensing for use; and wherein said toilet-paper-roll-holder.

15. The toilet paper guide system of claim 14 further comprising a kit including:

at least one said toilet paper guide assembly and a set of user instructions.

16. A method of using a toilet paper guide system comprising the steps of:

providing said toilet paper guide assembly of claim 14;

removably mounting said toilet paper guide assembly from a toilet-paper-roll-holder such that said toilet paper guide assembly occupies a hung-position below a roll of toilet paper; and feeding an end of said roll of toilet paper through said opening of said sleeve assembly such that a user can grasp said toilet paper and pull for dispensing for use.

17. The method of claim 16 further comprising the step of tearing said toilet paper by sustained contact against a tear-edge after dislodging an appropriate amount of said toilet paper.

* * * * *